US010151172B1

(12) United States Patent
Dallas

(10) Patent No.: US 10,151,172 B1
(45) Date of Patent: Dec. 11, 2018

(54) PRESSURE PERFORATED WELL CASING COLLAR AND METHOD OF USE

(71) Applicant: Lloyd Murray Dallas, Streetman, TX (US)

(72) Inventor: Lloyd Murray Dallas, Streetman, TX (US)

( * ) Notice: Subject to any disclaimer, the term of this patent is extended or adjusted under 35 U.S.C. 154(b) by 0 days.

(21) Appl. No.: 15/601,460

(22) Filed: May 22, 2017

(51) Int. Cl.

| | |
|---|---|
| ***E21B 43/26*** | (2006.01) |
| ***E21B 33/124*** | (2006.01) |
| ***E21B 34/06*** | (2006.01) |
| ***E21B 17/042*** | (2006.01) |
| ***E21B 17/08*** | (2006.01) |
| ***E21B 43/08*** | (2006.01) |
| ***E21B 43/267*** | (2006.01) |
| ***E21B 33/14*** | (2006.01) |
| ***E21B 34/08*** | (2006.01) |

(52) U.S. Cl.
CPC ..... *E21B 34/063* (2013.01); *E21B 17/042* (2013.01); *E21B 17/08* (2013.01); *E21B 33/124* (2013.01); *E21B 33/14* (2013.01); *E21B 34/08* (2013.01); *E21B 43/086* (2013.01); *E21B 43/267* (2013.01)

(58) Field of Classification Search
CPC ..... E21B 34/063; E21B 43/26; E21B 33/124
See application file for complete search history.

(56) References Cited

U.S. PATENT DOCUMENTS

| | | | | |
|---|---|---|---|---|
| 3,322,199 | A | 5/1967 | Van Note | |
| 3,468,386 | A | 9/1969 | Johnson | |
| 4,317,023 | A | 2/1982 | Gryskiewicz | |
| 6,009,947 | A | 1/2000 | Wilson et al. | |
| 6,543,539 | B1 | 4/2003 | Vinegar et al. | |
| 6,755,249 | B2 | 6/2004 | Robinson et al. | |
| 7,520,335 | B2 | 4/2009 | Richard et al. | |
| 7,789,163 | B2 | 9/2010 | Kratochvil et al. | |
| 8,739,879 | B2 | 6/2014 | King | |
| 8,863,850 | B2 * | 10/2014 | Sherman | E21B 34/063 137/382 |
| 9,121,265 | B2 | 9/2015 | Sherman | |
| 2004/0040707 | A1 * | 3/2004 | Dusterhoft | E21B 17/206 166/279 |
| 2006/0048946 | A1 | 3/2006 | Al-Muraikhi | |
| 2009/0014174 | A1 | 1/2009 | Hollies | |
| 2009/0321076 | A1 | 12/2009 | Wiley et al. | |
| 2015/0144347 | A1 | 5/2015 | Brannon et al. | |

OTHER PUBLICATIONS

American Petroleum Institute Bulletin 5C3, Fifth Edition, Jul. 1989, Bulleting on Formulas and Calculations for Casing, Tubing, Drill Pipe and Line Pipe Properties, pp. 16 and 17.
Canadian Patent Office Requisition dated Feb. 3, 2017—issued against corresponding Canadian Patent Application.

* cited by examiner

*Primary Examiner* — Catherine Loikith
(74) *Attorney, Agent, or Firm* — J. Bennett Mullinax, LLC

(57) ABSTRACT

Pressure perforated well casing collars have at least one pressure perforation groove cut to a consistent depth in an a sidewall of the well casing collar with sidewall bottom material at a bottom of the groove. The sidewall bottom material ruptures at a predetermined fluid pressure greater than a burst pressure rating of plain casing joints connected to the well casing collars to assemble a well casing string.

20 Claims, 7 Drawing Sheets

PRESSURE PERFORATED WELL CASING COLLAR AND METHOD OF USE

FIELD OF THE INVENTION

This invention relates in general to hydrocarbon well casing systems and, in particular, to a novel well casing collar that is pressure perforated after a casing string is assembled, inserted and cemented into a section of a recently drilled wellbore.

BACKGROUND OF THE INVENTION

Well casing is made up of casing joints and well casing collars for connecting the casing joints together to assemble a casing string. Well casing is commonly used to line recently drilled hydrocarbon wellbores to prevent borehole collapse and provide a smooth conduit for inserting tools required to complete the well for production and produce hydrocarbon from the well. Most hydrocarbon wells drilled today are vertical bores extending down to proximity of a hydrocarbon production zone and horizontal bores within the production zone. The vertical and the horizontal bores are cased in a manner well known in the art after they are drilled. The cased bore must be "completed" before hydrocarbon production can commence. Completing a cased well bore generally involves opening ports through the casing, followed by stimulating the production zone that surrounds the open casing ports by injecting high pressure fracturing fluids through the casing and into the formation. There are many known methods used to complete a cased well bore but only a few, such, as the openhole multistage system and plug-and-perf system, have achieved large-scale commercial success. All known methods of cased well completion suffer from certain drawbacks that are well understood by those skilled in the art.

Applicant's U.S. patent application Ser. No. 15/469,821 filed Mar. 27, 2017 and entitled Pressure Perforated Well Casing System describes a well casing system that overcomes many of the problems associated with the completion of cased well bores. In Applicant's well, casing system, pressure perforated well casing joints and/or pressure perforated well casing collars are assembled into a casing string that is inserted into a well bore and pressure perforated using high pressure fluid pumped from the surface after the casing string has been cemented in the well bore. However, additional research has now shown that even further improvements are achievable.

There therefore exists a need for a novel well casing collar that is pressure perforated after it is assembled in a well casing string that is inserted and cemented into a section of a recently drilled wellbore.

SUMMARY OF THE INVENTION

It is therefore an object of the invention to provide a well casing collar that is pressure perforated after it is assembled with plain casing joints into a well casing string that is inserted into a section of a recently drilled wellbore and cemented in the well bore.

The invention therefore provides a pressure perforated well casing collar, comprising: a pipe having a sidewall with a first end, a second end, an inner surface, an outer surface and a collar burst pressure rating; an internal thread on each of the first and second ends adapted to threadedly engage an external thread on a plain casing joint having a joint burst pressure rating; at least one pressure perforation groove cut in the outer surface, the at least one pressure perforation groove extending inwardly from the outer surface to an extent less than a thickness of the sidewall so there remains sidewall bottom material in the at least one pressure perforation groove, the sidewall bottom material having a rupture pressure rating that is greater than the joint burst pressure rating; whereby isolated fluid pressure applied within the pressure perforated well casing collar will cause the sidewall bottom material in the at least one pressure perforation groove to rupture before the collar burst pressure rating is reached, thereby opening at least one perforation through the sidewall of the well casing collar.

The invention yet further provides a pressure perforated well casing collar, comprising a pipe having a sidewall with a first end, a second end, an inner surface, an outer surface and a collar burst pressure rating; an internal thread on each of the first and second ends adapted to threadedly engage an external thread on a plain casing joint having a joint burst pressure rating; at least one pressure perforation groove cut in the outer surface, the at least one pressure perforation groove extending inwardly from the outer surface to an extent less than a thickness of the sidewall so there remains sidewall bottom material in the at least one pressure perforation groove, the sidewall bottom material having a rupture pressure rating that is greater than the joint burst pressure rating; whereby isolated fluid pressure applied within the pressure perforated well casing collar will cause the sidewall bottom material in the at least one pressure perforation groove to rupture before the collar burst pressure rating is reached, thereby opening at least one perforation through the sidewall of the well casing collar.

The invention yet further provides a method of fracturing a subterranean production zone after a well bore that penetrates the subterranean production zone has been drilled, comprising: assembling a casing string comprising well casing collars and plain well casing joints, the well casing collars respectively having a collar burst pressure rating and at least one pressure perforation groove cut to consistent depth in an outer surface thereof, the at least one pressure perforation groove having sidewall bottom material remaining in a bottom thereof, the sidewall bottom material having a rupture pressure rating, and the plain well casing joints having a joint burst pressure rating that is less than the rupture pressure rating; running the casing string into the well bore as it is assembled and cementing in the well casing string after it is run into the well bore; running a pressure isolation tool into the wellbore using a well completion string; locating a one of the well casing collars and setting uphole and downhole packers of the pressure isolation tool to isolate the well casing collar from the plain casing joints; pumping high pressure perforation fluid down the well completion string and through a port in the pressure isolation tool until the at least one pressure perforation groove ruptures and opens at least one perforation through the well casing collar; releasing the uphole and downhole packers of the pressure isolation tool and moving the pressure isolation tool downhole of the well casing collar; resetting the at least one of the packers of the pressure isolation tool; and pumping fracturing fluid down an annulus of the casing string and through the at least one perforation in the well casing collar to fracture the production formation.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a pressure perforated well casing collar that is used with plain casing joints to construct a well bore casing. In this document "plain well casing joint" means any API well casing pipe. The well casing collar has an outer sidewall with at least one pressure perforation groove. A rupture pressure of the at least one pressure perforation groove is higher than a burst pressure of the plain casing joints, which determines a maximum hydraulic fracturing pressure that can be used in the well. Consequently, a well casing collar can be pressure perforated and fracturing fluids can be pumped down the casing and through the pressure perforated casing collar without danger of perforating any other well casing collars uphole of the well casing collar just perforated. This permits hydrocarbon wells to be completed and fractured with greater efficiency and at less expense than prior art casing and completion systems. The well casing collar in accordance with the invention eliminates the need for sliding sleeves, openhole packers, wirelines, perforating gun systems, abrasive perforators, shaped charges, plugs and plug mills. In one embodiment the well casing collar in, accordance with the invention also reduces the pump horsepower requirement for completing a well by up to 60%, thus significantly reducing completion cost, simplifying job scheduling and condensing a footprint required at the wellhead. The well casing collar in accordance with invention also significantly reduces fracturing crew idle time while providing fracture location flexibility. The well casing collar in accordance with invention may be used in vertical or horizontal well bore completions and is equally effective and efficient in either a vertical or a horizontal well bore.

Figure 1:
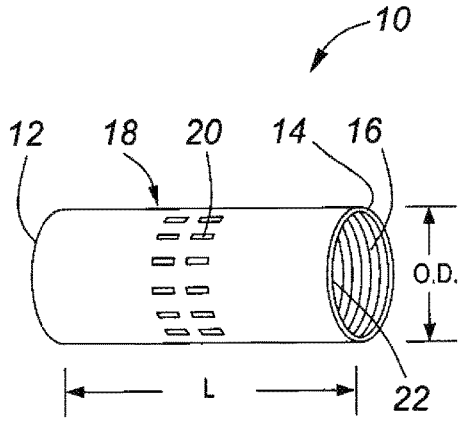
FIG. 1 is a schematic view of an embodiment of a pressure perforated well casing collar in accordance with the invention.

FIG. 1 is a schematic view of an embodiment of a pressure perforated well casing collar 10 in accordance with the invention. The well casing collar 10 has a first end 12, a second end 14 and a sidewall 18. An internal thread 16 cut within each of the first end 12 and the second end 14 is adapted to threadedly engage a plain well casing joint, as will be discussed in more detail below with reference to FIGS. 2-4 and 10. The well casing collar 10 has a length "L" and an outside diameter "OD". The OD is dependent on the size of plain well casing joints to be joined together to assemble a casing string for insertion into a recently bored hydrocarbon well bore. Typically, well casing is available in 4.5" (11.4 cm), 5.5" (13.97 cm), 7.5" (19.05 cm) or 7.625" (19.37 cm), although 3" (7.62 cm), and several other diameters of well casing are occasionally used. In accordance with the invention, the well casing collar 10 is manufactured from suitable pipe having a burst pressure rating (hereinafter "collar burst pressure rating") that is significantly greater than a burst pressure rating of the plain casing joints to be joined together using the well casing collar 10, as will be explained below in more detail with reference to FIGS. 3 and 4*a*-*b*. The length "L" of the well casing collar 10 is a matter of design choice, but in one embodiment the length "L" is kept to a minimum in order to reduce cost. In one embodiment the length "L" is about 3' (91.4 cm), though shorter or longer well casing collars 10 can be made for specific applications. At least one pressure perforation groove 20 is cut into the sidewall 18. The number and shape of the pressure perforation grooves 20 is dependent on any one or more of: production formation characteristics, hydrocarbon properties, and well operator choice. The pressure perforation grooves 20 in this embodiment are shown to be straight axial grooves, but the shape of the pressure perforation grooves 20 is a matter of design choice. It is only important that if more than one pressure perforation groove is cut, the pressure perforation grooves 20 are spaced far enough apart that any potential erosion (known in the art as "wash") from fracturing operations is not likely to join two or more pressure perforation grooves 20, which might compromise the strength of the well casing collar 10.

Figure 9A:
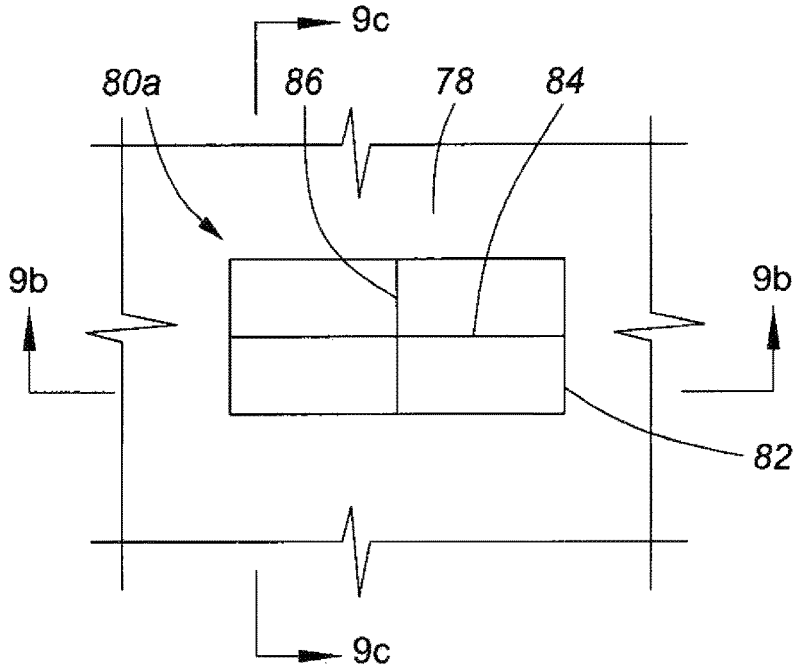
FIG. 9*a* is a detailed view of one embodiment of pressure perforation grooves that may be used for the embodiments of the well casing collar shown in FIGS. 5 and 7.
Figure 9B:
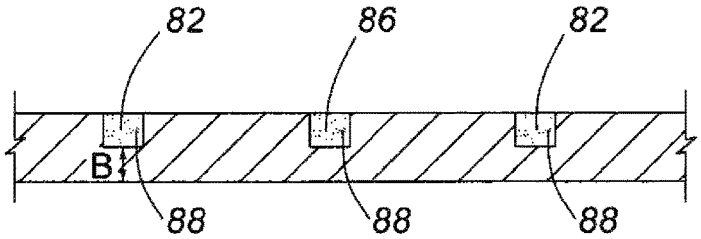
FIG. 9*b* is a cross sectional view taken along lines 9*b*-9*b* of FIG. 9*a;*
Figure 9C:
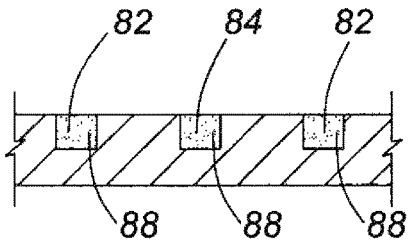
FIG. 9*c* is a cross sectional view taken along lines 9*c*-9*c* of FIG. 9*a;*

In one embodiment, each pressure perforation groove 20 is about 0.375%0.5" (1-1.27 cm) wide and 1"-3" (2.5-7.6 cm) long. The pressure perforation grooves 20 are not cut through the sidewall 18. Rather, a predetermined thickness of sidewall bottom material, explained below with reference to FIGS. 9*a*-9*c*, is left between a bottom of each groove 20 and an inner wall 22 of the well casing collar 10. The thickness of the sidewall bottom material is calculated to have a predetermined rupture pressure (yield strength). The predetermined rupture pressure is higher than a burst pressure rating of plain casing joints connected together by the well casing collar 10 to create a casing string. This has distinct operational advantages that will be explained below with reference to FIGS. 3, 4*a*, 4*b* and 11. When the sidewall bottom material ruptures, at least one perforation is opened though the collar sidewall 18 to provide access to a production formation. Although the predetermined rupture pressure is greater than the burst pressure rating of the plain casing joints, it is designed to be less than the maximum fluid pressure potential of modern fracturing pumps and completion tubing. Consequently, casing strings assembled using the well casing collar 10 are very robust and can be run into a recently bored well bore without hazard of well bore material intrusion. The casing strings can also be cemented in the well bore without danger of cement intrusion into the casing string because cementing operation pressures rarely exceed about 3,000 psi. Once the casing string is inserted into a recently drilled well bore and cemented in, the well casing collars 10 can be selectively perforated using a downhole pressure isolation tool which will be described, in principle only, with reference to FIGS. 3, 4*a* and 4*b*.

Figure 2:
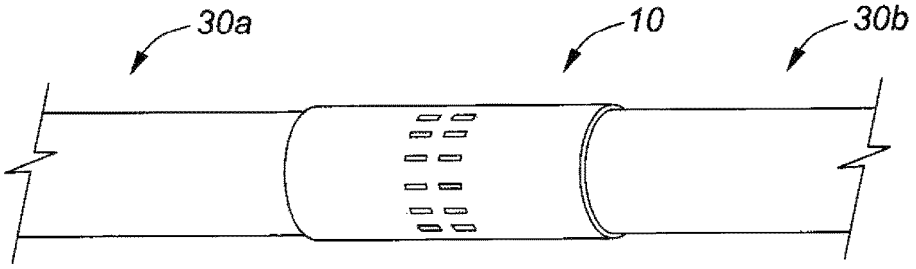
FIG. 2 is a schematic view of the well casing collar shown in FIG. 1 connected to plain casing joints in a well casing string.

FIG. 2 is a schematic view of the well casing collar 10 shown in FIG. 1 connected to plain casing joints 30*a*, 30*b* in a well casing string, only a small proportion of which is, shown. When used with plain casing joints 30*a*, 30*b* the well casing collar 10 provides access to a production zone in which the casing string is installed at intervals determined by a length of the plain casing joints 30*a*, 30*b* and a frequency of use of the well casing collars 10, each of which is typically specified by a well consultant or well operator. For example, a typical casing, joint 30*a*, 30*b* is 40' (12 m), an API Range 3 pipe. However, casing joints are available in API Range 1 lengths (16' to 25') and API Range 2 lengths (25' to 34'). Consequently, a wide range of spacing options for the well casing collars 10 is available using standard, plain well casing joints.

Figure 3:
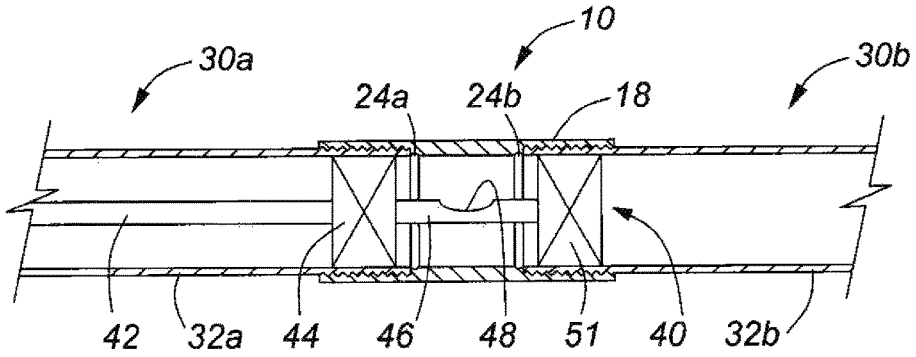
FIG. 3 is a schematic cross-sectional view of the well casing collar and the well casing joints shown in FIG. 2, illustrating the use of a pressure isolation tool to perforate the well casing collar shown in FIG. 1.

FIG. 3 is a schematic cross-sectional view of the well casing collar 10 and the plain casing joints 30*a*, 30*b* shown in FIG. 2, illustrating the use of a pressure isolation tool 40 to pressure perforate the well casing, collar 10 shown in FIG. 1. The construction and operation of the pressure isolation tool 40 is beyond the scope of this disclosure and will not be discussed in any detail aside from the methods of using the pressure isolation tool 40. In accordance with the invention, the pressure isolation tool 40 is run into the cased well bore after the casing has been cemented in and the cement has set, or partially set. In one embodiment, a length of the pressure isolation tool 40 is less than, or equal to, a length of the casing joint 10. The pressure isolation tool 40 is run into the casing on a bottom end of a well completion string 42. The well completion string 42 may be a coil tubing string suitable for lateral bores shorter than the "push limit" of coil tubing, or a jointed completion tubing string suitable for both shorter and longer lateral bores, each of which is well known in, the art. The isolation tool 40 includes packers 44, 51 mounted to opposite ends of a high pressure mandrel 46 having at least on port 48 in fluid communication with the completion tubing 42. The packers 44, 51 may be individually set and released. Both packers 44, 51 are set after the pressure isolation tool 40 is aligned with the well casing collar, which alignment is readily determined using a collar locator (not shown), well known to those skilled in the art. Because some plain casing joints "torque up" to the casing collar 10 without leaving a gap that is readily detectable by a collar locator, in one embodiment of the well casing collar 10 a pair of shallow internal identification grooves 24*a*, 24*b* are machined adjacent the internal threads 16 (see FIG. 1). The shallow internal identification grooves 24*a*, 24*b* are readily detectable by a collar locator, but they do not compromise a strength or burst pressure rating, of the well casing collar 10.

After the packers 44, 51 are set, high pressure perforating fluid is pumped down through the completion string 42 and the pressure isolation tool port(s) 48. The high pressure perforating fluid is contained between the set packers 44, 51 and isolated from the plain casing joints 30*a*, 30*b*. In accordance with one embodiment of the invention, the high pressure perforating fluid is fracturing fluid that contains no proppant, though the composition of the high pressure perforating fluid is a matter of design choice. Fluid pressure of the high pressure perforating fluid is monitored at the surface and pumping is initiated and continues until there is a dramatic pressure drop in the pumped fluid, indicating that the well casing collar has been perforated by the rupture of the pressure perforation grooves 20. Monitoring the pump rate gives a positive indication of, the number of pressure perforation grooves 20 that have been ruptured.

Figure 4A:
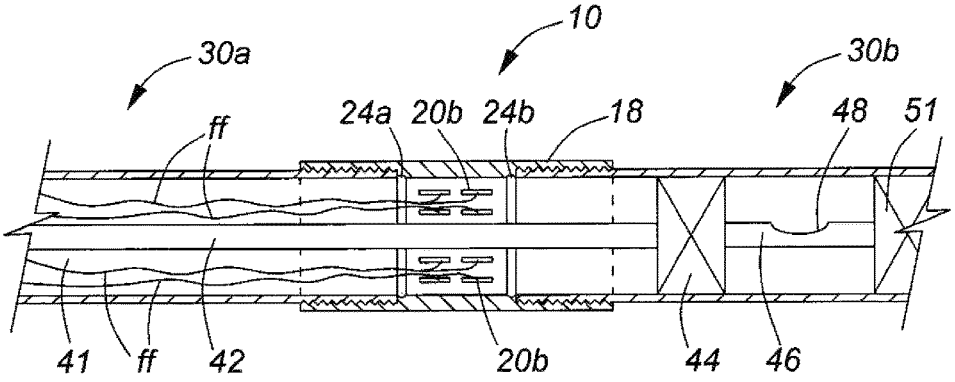
FIG. 4*a* is a schematic cross-sectional view of the well casing collar and the well casing joints shown in FIG. 3, illustrating a first method of fracturing a production zone using the well casing collar in accordance with the invention.

FIG. 4*a* is a schematic cross-sectional view of the well casing collar 10 and the well casing joints 30*a*, 30*b* shown in FIG. 3, illustrating a first method of fracturing a production zone using the well casing collar 10 in accordance with the invention. After the well easing collar 10 has been pressure perforated as explained above with reference to FIG. 3, the pumping of high pressure perforation fluid is terminated, the packers 44, 51 are released and the pressure isolation tool 40 is moved downhole of the well casing collar 10. The packers 44, 51 are then reset and fracturing fluid (ff) is pumped down an annulus 41 of the casing string and through the newly formed slots 20*b* in the well casing collar 10. In one embodiment, the fracturing fluid (ff) is pumped at a predetermined pressure that is generally near, but less than, a burst pressure rating of the plain casing joints 30*a*, 30*b*. Since the rupture pressure of uphole casing joints 10 is higher than the burst pressure rating of the plain casing joints, there is no danger that any of the well casing collars 10 uphole in the casing string will be perforated while fracturing through perforations just opened in a downhole well casing collar 10. The set packer 44 (uphole packer) prevents the fracturing, fluid (ff) from migrating downhole into zones previously fractured using this method in accordance with the invention. Pumping down the annulus 41 permits the fracturing fluid to be pumped at a high rate, so the fracturing of the production zone in communication with the slots 20*b* is accomplished quickly. Since the volume of fracturing fluid that can be pumped through the slots 20*b* is limited by the total open area of those slots, the total pump horsepower required to pump the fracturing fluid (ff) is up to 60% less than that required for most sliding sleeve and plug-n-perf fracturing procedures, thus reducing costs and surface footprint requirements.

Figure 4B:
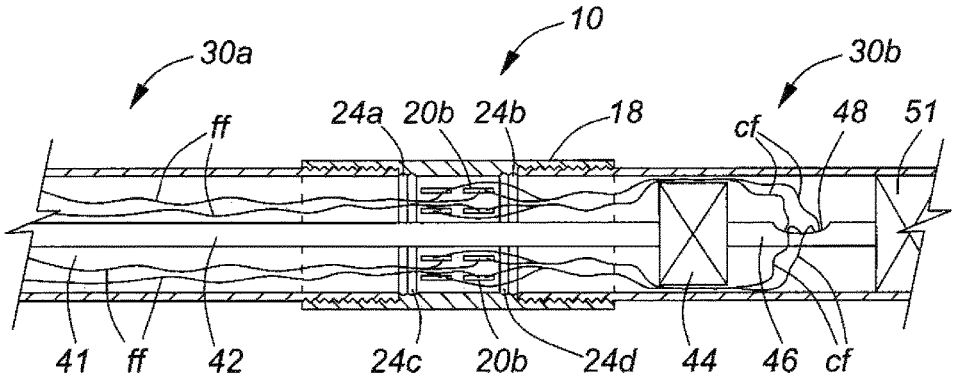
FIG. 4*b* is a schematic cross-sectional view of the well casing collar and the well casing joints shown in FIG. 3, illustrating a second method of fracturing the production zone using the well casing collar in accordance with the invention.

FIG. 4*b* is a schematic cross-sectional view of the well casing collar 10 and the well casing joints 32*a*, 32*b* shown in FIG. 3, illustrating a second method of fracturing the production zone after the well casing collar 10 has been pressure perforated. In this embodiment the pressure isolation tool 40 has been relocated downhole, but only packer 51 (downhole packer) is set. Uphole, packer 44 is left in a relaxed, unset condition and fluid can be pumped around it. Consequently, fracturing fluid (ff) is pumped down the annulus 41 of the casing string and through the newly formed slots 20*b* in the well casing collar 10 while fracturing fluid (cf) is pumped down the pressure isolation tool string 42 and through the newly formed slots 20*b* in the well casing collar 10. This provides a maximum fracturing fluid flow rate of that is substantially equal to the pump rate that can be accomplished down an open casing string. In one embodiment, the fracturing fluid stream (ff) carries the entire proppant load into the production zone while the fracturing fluid stream (cf) contains no proppant. This permits circulation up the annulus 41 of proppant-free fracturing fluid pumped through the completion string 42 to remove a proppant blockage in the event of a screen-out, which is well understood in the art. In this embodiment, 2 or more shallow internal identification grooves 24*a*, 24*c* and 24*b*, 24*d* are machined adjacent the internal thread in each end of the casing collar 10, The two or more shallow internal identification grooves 24*a*-24*d* are respectively detectable by a collar locator and can be used for identifying the well casing collars 10, as will be explained below in more detail with reference to FIGS. 5 and 7.

Figure 5:
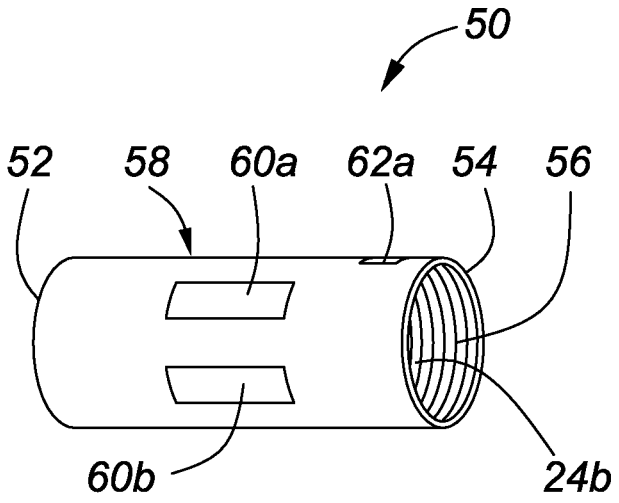
FIG. 5 is a schematic view of a another pressure perforated well casing collar in accordance with the invention.

FIG. 5 is a schematic view of another pressure perforated well casing collar 50 in accordance with the invention, which permits the practice of directional perforation. The well casing collar 50 has a first end 52, a second end 54, an internal thread 56 in each of the first end 52 and the second end 54, and an outer surface 58. In this embodiment at least one pressure perforation groove is located on only one side of the well casing collar 50. In one embodiment, first and second pressure perforation grooves 60*a*, 60*b* having overlapping ends are located on the one side of the well casing collar 50. An identification stamp 62*a* on a top surface of the well casing collar 50 identifies the side of the well casing collar 50 with the pressure perforation groove(s) 60*a*, 60*b*. Although two pressure perforation grooves 60*a*, 60*b* are shown, this is an example only. As explained above, the number of pressure perforation grooves is dependent mainly, but not exclusively, on formation characteristics. The pressure perforation grooves 60*a*, 60*b* are indexed to the internal thread 56 such that when the well casing collar 50 is connected to a plain casing joint 90*b* (see FIG. 10) and is torqued to a recommended makeup torque, the orientation of the pressure perforation grooves 60, 60*b* is consistently within ½ turn of any other well casing collar 50 having grooves cut in the same location. The exact orientation of the well casing collar 50 on the casing joint 90*b* cannot be controlled due to variations in an external thread on each end of the plain casing joints 90*b*. Nonetheless, a rig operator assembling a casing string can under-torque or over-torque the connection between a well casing collar 50 and casing joint 90*b* by % turn to achieve a consistent orientation of the well casing collar 50 on the plain casing joint 90*b*, without affecting the integrity of the casing string. The advantages of this directional perforation will be explained below with reference to FIGS. 10 and 11. In one embodiment, the casing collar 50 can also be identified in a casing string after it is inserted in a well bore by the number of shallow internal identification grooves 24*a*-24*d* in the casing collar 50 detected by a collar locator.

Figure 6:
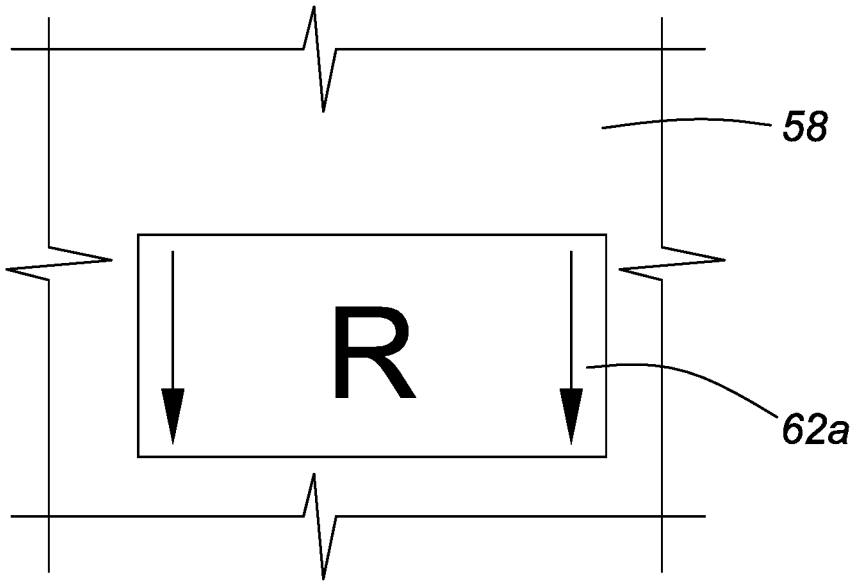
FIG. 6 is a schematic top plan view of an identification stamp on a top surface of the well casing collar shown in FIG. 5.

FIG. 6 is a schematic top plan view of one embodiment of the identification stamp 62*a* on the outer surface 58 of the well casing collar 50 shown in FIG. 5. In one embodiment, the identification stamp 62*a* includes at least one arrow indicating a downhole orientation of the well casing collar 50 and a letter indicating that the pressure perforation grooves are on a given side of the well casing collar 50 when it is connected to a casing string. In this example, the letter "R" indicates that the pressure perforation grooves are on the right side of the well casing collar 50. This permits a rig crew to rapidly adjust a torque of the connection, if required, to achieve the desired orientation as the casing string is assembled and lowered into a wellbore.

Figure 7:
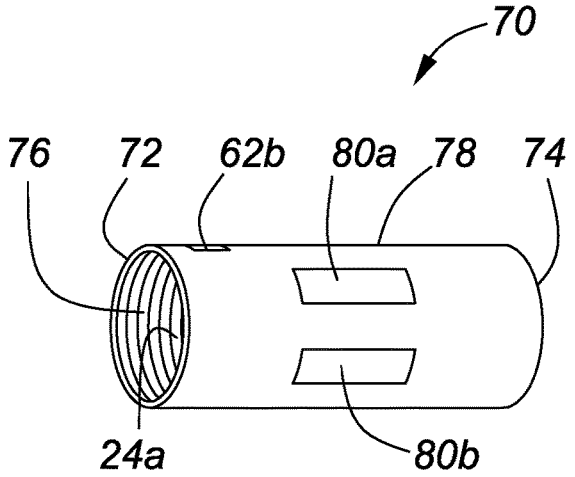
FIG. 7 is a schematic view of a further pressure perforated well casing collar in accordance with the invention.

FIG. 7 is a schematic view of a further pressure perforated well casing collar 70 in accordance with the invention. The well casing collar 70 is identical to the well casing collar 50, except that the at least one pressure perforation groove(s) 80*a*, 80*b* is on the left side of the well casing collar. Although two pressure perforation grooves 80*a*, 80*b* are shown, this is an example only. As explained above, the number of pressure perforation grooves is dependent mainly, but not exclusively, on formation characteristics. The well casing collar 70 has a first, end 72, a second end 74, an internal thread 76 in each of the first end 72 and the second end 74, and a sidewall 78. In this embodiment the at least one pressure perforation groove is located on only the left side of the well casing collar 70. An identification stamp 62*b* on a top of the sidewall 78 indicates that. In one embodiment, the casing collar 70 can also be identified in a casing string after it is inserted in a well bore by the number of shallow internal identification grooves 24*a*-24*d* in the casing collar 70 detected by a collar locator.

Figure 8:
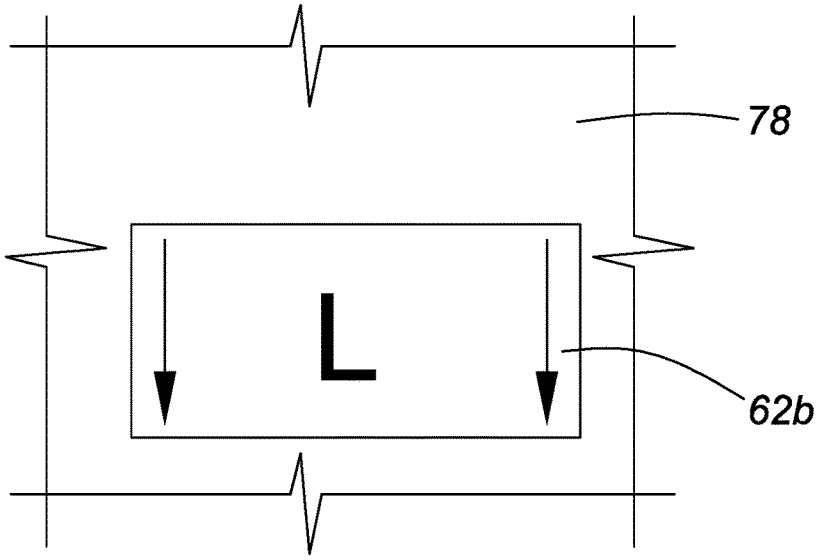
FIG. 8 is a schematic top plan view of an identification stamp on a top surface of the well casing collar shown in FIG. 7.

FIG. 8 is a schematic top plan view of the identification stamp 62*b* on the sidewall 78 of the well casing collar 70 shown in FIG. 7. In one embodiment, the identification stamp includes at least one arrow indicating a downhole orientation of the well casing collar 70 and a letter "L", indicating that the pressure perforation grooves are on, the left side of the well casing collar 70 when it is connected to a casing string. This permits the rig crew to rapidly adjust a torque of the connection, if required, to achieve the desired orientation as the casing string is assembled.

In practice, the well casing collars 50, 70 are connected to respective plain casing joints at the recommended makeup torque to assemble collar-50-plain-joint, collar-70-plain-joint combinations that are placed in the pipe rack of the drill rig. The collar-50-plain-joint, collar-70-plain-joint combinations are then arranged in the pipe rack in alternating order so the rig crew has to simply pick them up in order and connect them together while making any minor torque adjustments required to maintain the desired directional orientation of the pressure perforation grooves as the casing string is inserted into the well bore.

FIG. 9*a* is a detailed view of one embodiment of pressure perforation grooves that may be used for the embodiments of the well casing collar shown in FIGS. 5 and 7. In this embodiment the pressure perforation groove 80*a* in the outer surface sidewall 78 of the well casing collar 70 (see FIG. 7) has an outer groove 82 with overlapping ends. At least one pressure perforation groove 84 longitudinally bisects the rectangle defined by the outer pressure perforation groove 82, and at least one pressure perforation groove 86 transversely bisects the rectangle defined by the outer pressure perforation groove 82. Each of the pressure perforation grooves 82, 84 and 86 are cut to the same depth, leaving a thickness "B" (see FIG. 9*b*) of sidewall bottom material. The thickness "B" of sidewall bottom material may be calculated, for example, using a formula (Formula 1) described on page 16 and 17 of American Petroleum Institute Bulletin 5C3, Fifth Edition, July, 1989, incorporated herein by reference, to achieve the desired rupture pressure of the sidewall bottom material. The formula is:

$$P_y = 0.7854(D^2 - d^2)Y_p \quad \text{(Formula 1)}$$

where: $P_y$=pipe body yield strength in pounds rounded to nearest 1000;

$Y_p$=Specified minimum yield strength for pipe, psi;

D=specified outside diameter, inches;

d=specified inside diameter, inches.

FIG. 9*b* is a cross sectional view taken along lines 9*b*-9*b* of FIG. 9*a* showing the pressure perforation grooves 82, 86. In one embodiment the pressure perforation grooves 82, 86 are filled with a coating compound 88 designed to protect the machined surfaces while the well casing collar 10, 50 or 70 is in storage and while it is being run into a recently drilled well bore. The coating compound 88 also prevents the intrusion of cement into the pressure perforation grooves but remains soft to facilitate rupture of the sidewall bottom material under fluid pressure. Such coating compounds are available, for example, from Masterbond, Hackensack, N.J., U.S.A.

FIG. 9*c* is a cross sectional view taken along lines 9*c*-9*c* of FIG. 9*a* showing groove 82 and 84 filled with coating compound 88. The advantage of the longitudinal pressure perforation groove 84 and transverse pressure perforation groove 86 is that the intersection of those grooves is the weakest point in the sidewall 78 of the well casing collar 70. Consequently rupture occurs there first, driving the resulting four sharp points of the ruptured steel through the well bore cement before the entire perforation tears away from the sidewall 78 of the casing joint 70 and breaks up the well bore cement as the four segments are driven into the formation behind the well bore cement.

Figure 10:
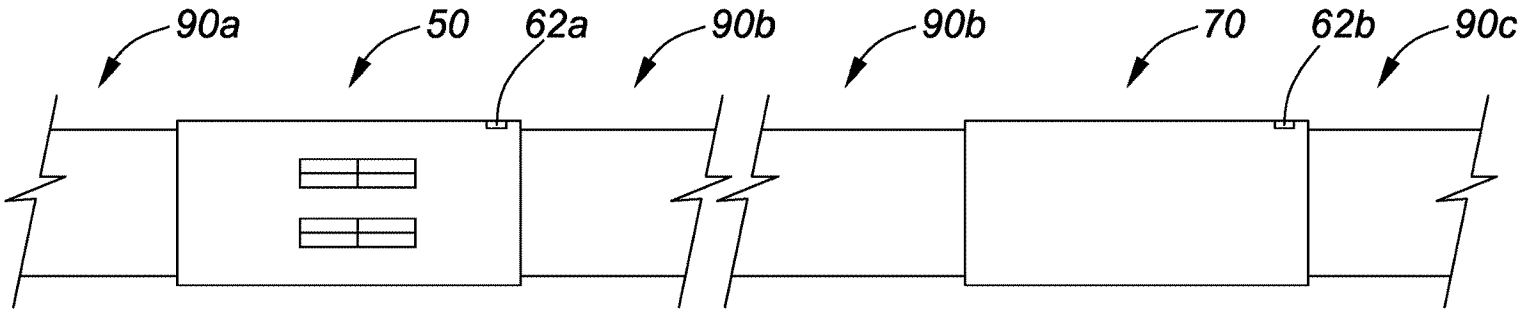
FIG. 10 is a schematic diagram of one embodiment of a casing string assembled in accordance with the invention.

FIG. 10 is a schematic diagram of one embodiment of part of a casing string assembled in accordance with one embodiment of the invention. In this embodiment a plain casing joint 90*a* is connected to a top end of the well casing collar 50; a plain casing joint 90*b* is connected to a bottom end of well casing collar 50 and a top end of well casing collar 70; and, a plain well casing joint 90*c* is connected to a bottom end of the well casing collar 70. The entire casing string is assembled in this fashion, alternating well casing collars 50 and 70 so that the pressure perforations are on opposite sides of the casing string as it is lowered into the wellbore. Although the downhole orientation of the casing string cannot be guaranteed, the in-string orientation of perforations alternating on opposite sides of the casing string can be ensured, as can the proper orientation of the casing string as it enters the wellbore. The benefits of this oriented perforation will be explained below with reference to FIG. 11.

Figure 11:
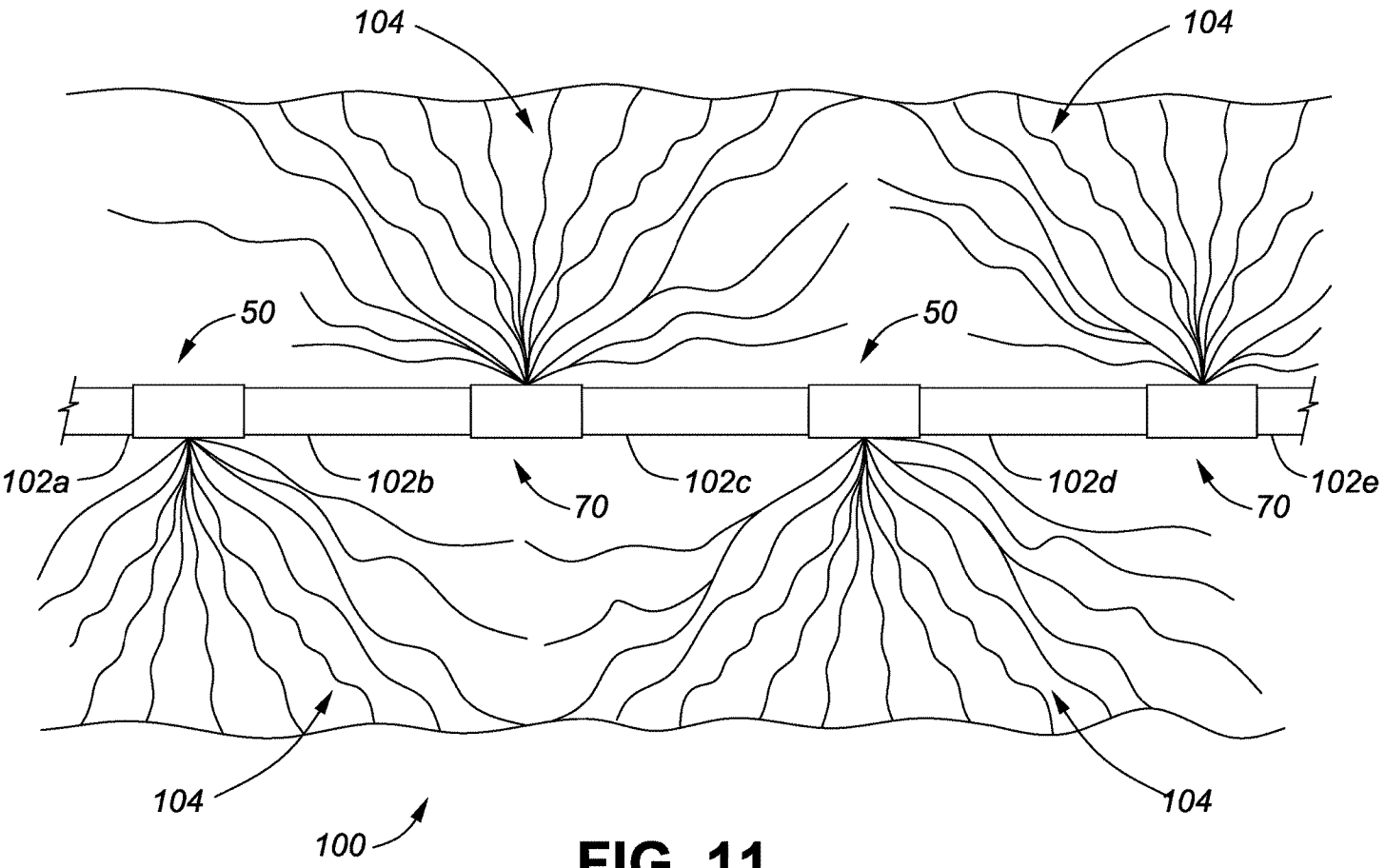
FIG. 11 is a schematic diagram of a theoretical fracture pattern of a subterranean production zone after it has been fractured via a casing string assembled with well casing collars shown in FIGS. 5 and 7.

FIG. 11 is a schematic diagram of a theoretical fracture pattern of a proportion of a subterranean production zone 100 after it has been fractured via a casing string assembled with plain casing joints and well casing, collars 50, 70 shown in FIGS. 5 and 7. Plain casing joints are interconnected by well casing collars 50, 70 in an alternating pattern as follows: casing joint 102*a*, well casing collar 50, casing joint 102*b*, well casing collar 70, casing joint 102*c*, well casing collar 50, casing joint 102*d*, well casing collar 70, casing joint 102*e*, etc. A distance between the well casing collars 50, 70 is dependent on a length of the plain casing joints 102. The length of the plain casing joints is a design choice, which may be production formation dependent and selected by a production consultant or well operator. Furthermore, plain casing joints of the same length need not be used throughout any given casing string. This provides a great deal of flexibility in determining a location of fracture propagation points in the formation. Since most production zones extend horizontally in a relatively narrow band, it is advantageous to have the fractures propagate laterally of the casing string. This can be readily achieved using the well casing collars 50, 70 in accordance with the invention. Furthermore, since the casing string is cemented in before it is perforated, each fracture propagation point is guaranteed and is not a matter of chance. In shale formations, for example, it is likely that fractures 104 will propagate in both directions from the pressure perforation points provided by the well casing collars 50, 70. The fractures 104 will generally propagate until they begin to interconnect with downhole fractures 104 previously propagated. Fracture interconnection is indicated at surface by a pressure drop in the fracturing fluid, indicating that fracturing through a well casing collar 50, 70 can be terminated.

The well casing collars 10, 50 and 70 in accordance with the invention are ideally adapted for use in modern production techniques such as described in Applicant's U.S. Pat. No. 9,644,463 which issued May 9, 2017, the entire specification of which is incorporated herein by reference.

In fact, the casing collars 10, 50, 70 can be used in novel ways to produce hydrocarbons from long lateral well bores. Using the shallow internal identification grooves 24*a*-24*d* (see FIG. 4*b*, for example) to identify alternate casing collars 10, a long lateral well bore can be completed by pressure perforating every second casing collar 10. After production from the well bore is no longer economically viable, the unperforated casing collars can be located using the shallow internal identification grooves 24*a*-24*d*. Those unperforated casing collars can then be perforated in sequence and stimulation fluids pumped through the newly perforated casing collars 10, after which the long lateral well bore can once more be produced.

In another variation, the shallow internal identification grooves may be used to distinguish well casing collars 50 from well casing collars 70. This permits a first side (for example, casing collars 50) of a long lateral well bore to be completed and produced while the opposite side (for example, casing collars 70) is left unperforated and not produced. After hydrocarbon production from the first side of the long lateral wellbore is complete, the remaining casing collars (casing collars 70 in this example) are perforated in sequence and fractures are propagated from each perforated casing collar. Production of hydrocarbons from the opposite side of the long lateral well bore can then commence. Of course these novel methods can be used on any proportion of a long lateral wellbore at a time.

The explicit embodiments of the invention described above have been presented by way of example only. The scope of the invention is therefore intended to be limited solely by the scope of the appended claims.

I claim:

1. A pressure perforated well casing collar, comprising:

a pipe having a sidewall with a first end, a second end, an inner surface, an outer surface and a collar burst pressure rating;

an internal thread on each of the first and second ends adapted to threadedly engage an external thread on a plain casing joint having a joint burst pressure rating;

at least one pressure perforation groove cut in the outer surface, the at least one pressure perforation groove extending inwardly from the outer surface to an extent less than a thickness of the sidewall so there remains sidewall bottom material in the at least one pressure perforation groove, the sidewall bottom material having a rupture pressure rating that is greater than the joint burst pressure rating;

whereby isolated fluid pressure applied within the pressure perforated well casing collar will cause the sidewall bottom material in the at, least one pressure perforation groove to rupture before the collar burst pressure rating is reached, thereby opening at least one perforation through the sidewall of the well casing collar.

2. The pressure perforated well casing collar as claimed in claim 1, wherein the at least one pressure perforation groove is filled with a coating compound to protect machined surfaces while the well casing collar is in storage and while a casing string including the well casing collar is being run into a recently drilled well bore.

3. The pressure perforated well casing collar as claimed in claim 1 wherein the at least one pressure perforation groove has overlapping ends.

4. The pressure perforated well casing collar as claimed in claim 3 wherein the at least on pressure perforation groove further comprises at least one of a longitudinal and a transverse pressure perforation groove within the at least one pressure perforation groove having overlapping ends.

5. The pressure perforated well casing collar as claimed in claim 1 wherein the at least one pressure perforation groove is indexed to the internal thread on the first end of the well casing collar so that the at least one pressure perforation groove is always within a ½ turn of a predetermined side of casing string when the well casing collar is connected to the casing string and torqued to a predetermined recommended torque.

6. The pressure perforated well casing collar as claimed in claim 5 further comprising a stamp on the outer surface of the well casing collar indicating an orientation of the well casing collar in the casing string and a side of the casing string on which at least one pressure perforation groove will be when the well casing collar is connected to the casing string and torqued to the predetermined recommended torque.

7. The pressure perforated well casing collar as claimed in claim 1 further comprising at least one shallow internal identification groove adjacent the internal thread.

8. A pressure perforated well casing system, comprising:

well casing collars respectively having a collar burst pressure rating, each well casing collar having at least one pressure perforation groove cut to a consistent depth in an outer surface thereof, the at least one pressure perforation groove having sidewall bottom material remaining in a bottom of the pressure perforation groove and the sidewall bottom material having a rupture pressure rating;

a plain well casing joint having a joint burst pressure rating, the joint burst pressure rating being less than the groove rupture pressure rating;

whereby after the well casing collars are used to connect the plain casing joints to form a casing string that is run into a recently drilled well bore, sufficient isolated fluid pressure applied to the at least one pressure perforation groove of a one of the well casing collars will cause the sidewall bottom material in the at least one groove to rupture before the collar burst pressure rating of the well casing collar is reached, thereby opening at least one perforation through the sidewall of the well casing collar at the at least one pressure perforation groove.

9. The pressure perforated well casing system as claimed in claim 8 wherein the at least one pressure perforation groove in the well casing collar are straight grooves.

10. The pressure perforated well casing system as claimed in claim 8 wherein the at least one pressure perforation groove in the well casing collar has ends that overlap.

11. The pressure perforated well casing, system as claimed in claim 10 wherein the at least one pressure perforation groove further comprises at least one of a longitudinal and a transverse pressure perforation groove within the at least one pressure perforation groove having overlapping ends.

12. The pressure perforated well casing system as claimed in claim 8 wherein the at least one pressure perforation groove is filled with a coating compound to prevent corrosion of machined surfaces and inhibit intrusion of cement when the casing string is cemented in.

13. The pressure perforated well casing system as, claimed in claim 8 wherein the well casing collars further comprise at least one shallow internal identification groove detectable by a collar locator.

14. A method of fracturing a subterranean, production zone after a well bore that penetrates the subterranean production zone has been drilled, comprising:

assembling a casing string comprising well casing collars and plain well casing joints, the well casing collars respectively having a collar burst pressure rating and at least one pressure perforation groove cut to consistent depth in an a sidewall thereof, the at least one pressure perforation groove having sidewall bottom material remaining in a bottom thereof, the sidewall bottom material having a rupture pressure rating, and the plain well casing joints having a joint burst pressure rating that is less than the rupture pressure rating;

running the casing string into the well bore as it is assembled and cementing in the well casing string after it is run into the well bore;

running a pressure isolation tool into the wellbore using a well completion string;

locating a one of the well casing collars and setting uphole and downhole packers of the pressure isolation tool to pressure isolate the well casing collar from the plain casing joints;

pumping high pressure perforation fluid down an annulus of the well completion string and through a port in the pressure isolation tool until the at least one pressure perforation groove ruptures and opens at least one perforation through the well casing collar;

releasing the uphole and downhole packers of the pressure isolation tool and moving the pressure isolation tool downhole of the well casing collar;

resetting at least one of the packers of the pressure isolation tool; and pumping fracturing fluid down an annulus of the casing string and through the at least one perforation in the well casing collar to fracture the production formation.

15. The method as claimed in, claim 14 wherein the step of setting at least one of the packers of the pressure isolation tool comprises setting the uphole packer of the pressure isolation tool.

16. The method as claimed in claim 14 wherein the step of setting at least one of the packers of the pressure isolation tool, comprises setting the downhole packer of the pressure isolation tool.

17. The method as claimed in claim 16 further comprising:

while pumping fracturing fluid down the annulus of the casing string, simultaneously pumping fracturing fluid down the annulus of the completion string though the port in the pressure isolation tool and around the uphole packer into the at least one perforation in the well casing collar.

18. The method as claimed in claim 17 wherein the fracturing fluid pumped down the annulus of the casing string carries all the proppant to be pumped through the at least one perforation in the well casing collar.

19. The method as claimed in claim 14 wherein, when a screen-out occurs, the method further comprises:

ensuring the downhole packer is set and the uphole packer is unset; and pumping fluid free of proppant down the completion tubing through the port of the pressure isolation tool and around the uphole packer to circulate the screened-out proppant uphole and out of the well bore.

20. The method as claimed in claim 14 further comprising the steps of:

releasing the at least one packer of the pressure isolation tool and pulling up the pressure isolating tool to locate a next well casing collar of the casing string;

setting the uphole and the downhole packers of the pressure isolation tool to pressure isolate the well casing collar from the plain casing joints;

pumping high pressure perforation fluid down the well completion string and through the port in the pressure isolation tool until the at least one pressure perforation groove ruptures and opens at least one perforation through the well casing collar;

releasing the uphole and downhole packers of the pressure isolation tool and moving the pressure isolation tool downhole of the well casing collar;

resetting at least the uphole packer of the pressure isolation tool;

pumping fracturing fluid down an annulus of the casing string and through the at least one perforation in the well casing, collar to fracture the production formation; and repeating these steps until all of the well casing collars of the casing string have been perforated and fracturing fluid has been pumped through all of the perforations in the well casing collars.

* * * * *